US010063036B2

(12) United States Patent
Kozakai et al.

(10) Patent No.: US 10,063,036 B2
(45) Date of Patent: Aug. 28, 2018

(54) SPARK PLUG

(71) Applicant: NGK SPARK PLUG CO., LTD., Nagoya-shi, Aichi (JP)

(72) Inventors: Yohei Kozakai, Nagoya (JP); Satoshi Nagasawa, Komaki (JP); Akira Suzuki, Nagoya (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days.

(21) Appl. No.: 15/264,971

(22) Filed: Sep. 14, 2016

(65) Prior Publication Data

US 2017/0077681 A1 Mar. 16, 2017

(30) Foreign Application Priority Data

Sep. 16, 2015 (JP) ..... 2015-182469

(51) Int. Cl.

| | |
|---|---|
| ***H01T 13/20*** | (2006.01) |
| ***H01T 13/36*** | (2006.01) |
| *H01T 13/12* | (2006.01) |
| *H01T 13/39* | (2006.01) |

(52) U.S. Cl.

CPC ..... *H01T 13/20* (2013.01); *H01T 13/36* (2013.01); *H01T 13/12* (2013.01); *H01T 13/39* (2013.01)

(58) Field of Classification Search

CPC ..... H01T 13/20; H01T 13/36; H01T 13/12
See application file for complete search history.

(56) References Cited

U.S. PATENT DOCUMENTS

| | | | | |
|---|---|---|---|---|
| 6,809,463 | B2 | 10/2004 | Suzuki | 313/141 |
| 6,909,226 | B2 | 6/2005 | Suzuki | |
| 8,922,103 | B2 | 12/2014 | Yoshimoto et al. | |
| 2003/0155850 | A1 | 8/2003 | Suzuki | 313/143 |
| 2003/0168954 | A1* | 9/2003 | Suzuki | H01T 21/02 313/141 |
| 2013/0009538 | A1 | 1/2013 | Yoshimoto et al. | |
| 2014/0299236 | A1* | 10/2014 | Anelli | C21D 8/105 148/504 |

FOREIGN PATENT DOCUMENTS

| | | | |
|---|---|---|---|
| JP | 2003-257584 A | 9/2003 | H01T 13/20 |
| JP | 2003257582 A | 9/2003 | |
| JP | 2011228250 A | 11/2011 | |

OTHER PUBLICATIONS

"Steels—Micrographic determination of the apparent grain size." Japanese Industrial Standard, JIS G 0551: 2005 (E) (Translated and Published by Japanese Standards Association).
Notification of Reasons for Refusal issued in corresponding Japanese Patent Application No. 2015-182469 dated Aug. 24, 2017.

* cited by examiner

*Primary Examiner* — Kevin Quarterman
(74) *Attorney, Agent, or Firm* — Kusner & Jaffe

(57) ABSTRACT

A spark plug includes an insulator having an axial hole formed therethrough in the direction of an axis of the spark plug, a center electrode disposed in a front side of the axial hole and a metal shell disposed around an outer circumference of the insulator and having a collar-shaped tool engagement portion and a crimp portion located on a rear side of the tool engagement portion and reduced in diameter toward the rear, wherein the crimp portion of the metal shell is made of a carbon steel material having a grain size number equal to or greater than No. 11 as measured according to JIS G 0551.

6 Claims, 4 Drawing Sheets

SPARK PLUG

RELATED APPLICATIONS

This application claims the benefit of Japanese Patent Application No. 2015-182469, filed Sep. 16, 2015, the entire contents of which is incorporated herein by reference.

FIELD OF THE INVENTION

The present invention relates to a spark plug, particularly of the type in which a metal shell has strength capable of, even when made small in diameter and thickness, being fixed to an insulator by crimping with a sufficient force to ensure air tightness.

Hereinafter, the term "front" refers to a spark discharge side with respect to the direction of an axis of a spark plug; and the term "rear" refers to a side opposite the front side.

BACKGROUND OF THE INVENTION

A spark plug for an internal combustion engine, such as vehicle engine, generally includes a rod-shaped center electrode, a substantially cylindrical insulator disposed around an outer circumference of the center electrode, a substantially cylindrical metal shell disposed around an outer circumference of the insulator and a ground electrode joined to a front end of the metal shell so as to define a spark discharge gap between a front end portion of the center electrode and a distal end portion of the ground electrode.

There has recently been a demand to reduce the size and diameter of the spark plug for the purpose of improvements in engine layout flexibility. For example, it is conceivable to reduce the diameter and thickness of the metal shell for size/diameter reduction of the spark plug.

It is common practice to fix the metal shell to the insulator by inserting the insulator through the metal shell, with the center electrode fitted in a front end side of the insulator, and radially inwardly crimping a rear end portion (also referred to as "crimp portion") of the metal shell onto the insulator. The crimp portion of the metal shell is made relatively thin so as to be crimped onto the insulator. When the metal shell is made small in diameter and thickness, such a thin crimp portion deteriorates in strength and cannot be crimped with a sufficient force to ensure air tightness.

As a solution to the above problem, Japanese Laid-Open Patent Publication No. 2003-257584 (abbreviated as "JP 2003-257584 A") discloses a spark plug that has a metal shell formed of a steel material and including a crimp portion with a reduced cross-sectional area, in which the steel material of the metal shell has a carbon content increased depending on the cross-sectional area of the crimp portion so as to impart strength to the crimp portion such that, even when the metal shell is made small in diameter, the crimp portion can be fixed to an insulator with a sufficient crimping force to improve air tightness and vibration resistance (see paragraph [0009] of JP 2003-257584 A).

SUMMARY OF THE INVENTION

In recent years, the size/diameter reduction of the spark plug has been increasingly demanded. There is thus a demand to further increase the strength of the metal shell. One method of increasing the strength of the metal shell is to produce the metal shell from a high carbon steel material as disclosed in JP 2003-257584 A. The higher the carbon content of the steel material, the higher the strength of the steel material. On the other hand, the steel material becomes more difficult to deform and thereby deteriorates in workability as the carbon content of the steel material increases. For this reason, it is demanded to increase the strength of the metal shell while maintaining the workability of the metal shell material without increase in carbon content.

In view of the foregoing, an advantage of the present invention is a spark plug of the type in which a metal shell has strength capable of, even when made small in diameter and thickness, being fixed to an insulator by crimping with a sufficient force to ensure air tightness According to one aspect of the present invention, there is provided a spark plug, comprising: an insulator having an axial hole formed therethrough in the direction of an axis of the spark plug; a center electrode disposed in a front side of the axial hole; and a metal shell disposed around an outer circumference of the insulator and including a collar-shaped tool engagement portion and a crimp portion located on a rear side of the tool engagement portion and reduced in diameter toward the rear, wherein the crimp portion of the metal shell is formed of a carbon steel material having a grain size number equal to or greater than No. 11 as measured according to JIS G 0551.

The following configurations (i), (ii) and (iii) are preferred for the above spark plug.

(i) The carbon steel material has a mean lineal grain length of 0.01 mm or smaller where the mean lineal grain length is an arithmetic mean value of lengths of crystal grains situated on a line segment parallel to the axis of the spark plug.

(ii) The carbon steel material has an intercepted grain number greater than or equal to 200 as measured according to JIS G 0551.

(iii) The carbon steel material contains Fe as a main component, 0.03 to 0.3 mass % of C, 0.3 to 0.9 mass % of Mn, 0.1 to 0.8 mass % of Si and 0.001 to 0.1 mass % of S.

In the present invention, the crimp portion of the metal shell is formed of the carbon steel material having a grain size number equal to or greater than No. 11 as measured according to JIS G 0551. This carbon steel material is smaller in grain size than those used for conventional metal shells. The crimp portion of the metal shell is thus made higher in strength than those of the conventional metal shells. Accordingly, the metal shell (crimp portion) attains strength capable of, even when made small in diameter and thickness, being fixed to the insulator by crimping with sufficient force to ensure air tightness.

The other advantages and features of the present invention will also become understood from the following description.

DETAILED DESCRIPTION OF THE PREFERRED EMBODIMENTS

A spark plug 1 for an internal combustion engine according to one embodiment of the present invention will be described below with reference to the drawings. It is noted that, as already mentioned before, the term "front" refers to a spark discharge side with respect to the direction of an axis O of the spark plug 1; and the term "rear" refers to a side opposite the front side.

Figure 1:
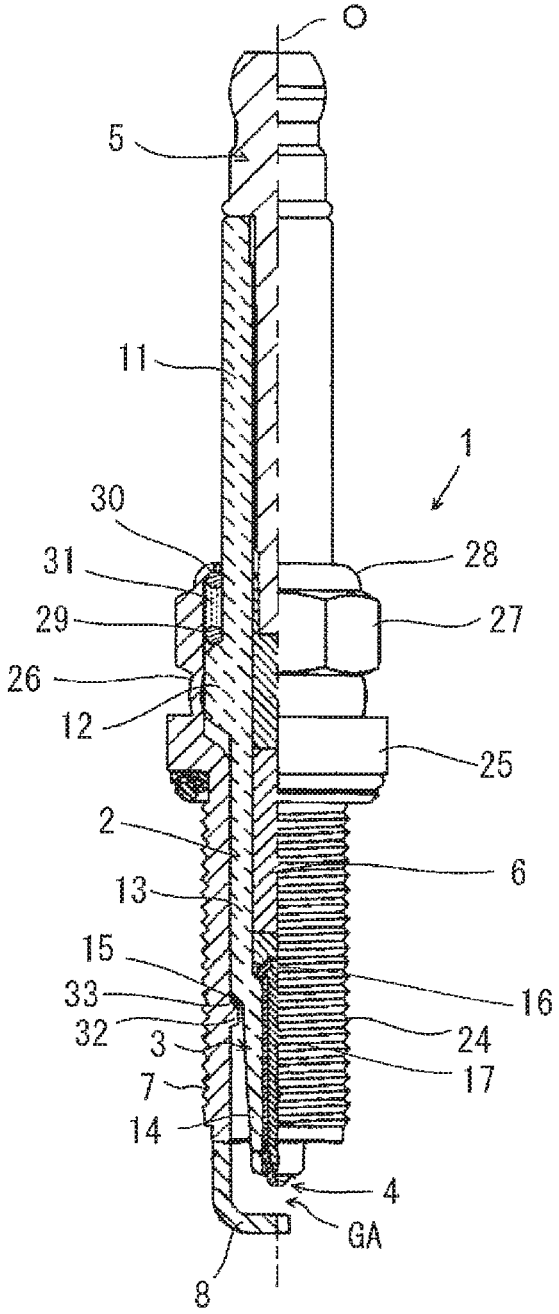
FIG. 1 is a schematic view, partially in section, of a spark plug according to one embodiment of the present invention.

As shown in FIG. 1, the spark plug 1 includes a substantially cylindrical insulator 3 having an axial hole 2 formed therethrough in the direction of the axis O, a substantially rod-shaped center electrode 4 disposed in a front side of the axial hole 2, a terminal rod 5 disposed in a rear side of the axial hole 2, a connection part 6 arranged between the center electrode 4 and the terminal rod 5 within the axial hole 2, a substantially cylindrical metal shell 7 disposed around an outer circumference of the insulator 3 and a ground electrode 8 having a base end portion joined to a front end portion of the metal shell 7 and a distal end portion facing the center electrode 4 via a gap GA.

The insulator 3 has a substantially cylindrical shape, with the axial hole 2 formed therethrough in the direction of the axis O. In the present embodiment, the insulator 3 includes a rear body portion 11, a large diameter portion 12, a front body portion 13 and a leg portion 14. The rear body portion 11 is shaped so as to accommodate therein the metal terminal 5 and keep the metal terminal 5 insulated from the metal shell 7. The large diameter portion 12 is located on a front side of the rear body portion 11 and shaped so as to protrude radially outwardly in a collar shape. The front body portion 13 is located on a front side of the large diameter portion 12 and shaped with a smaller outer diameter than that of the large diameter portion 12 so as to accommodate therein the connection part 6 and keep the connection part 6 insulated from the metal shell 7. The leg portion 14 is formed on a front side of the front body portion 13 and shaped with smaller outer and inner diameters than those of the front body portion 13 so as to accommodate therein the center electrode 4 and keep the center electrode 4 insulated from the metal shell 7. The insulator 3 further includes a step portion 15 formed between the front body portion 13 and the leg portion 14. The insulator 3 is fixed in the metal shell 7, with a front end portion of the insulator 3 protruding from a front end of the metal shell 7. The insulator 3 can be formed of a material having mechanical strength, thermal strength and electrical insulating properties.

The connection part 6 is located between the center electrode 4 and the metal terminal 5 within the axial hole 2 so as to not only fix the center electrode 4 and the metal terminal 5 in position within the axial hole 2 but also establish electrical connection between the center electrode 4 and the metal terminal 5. The connection part 6 can be formed by mixing a glass powder, a non-metallic conductive powder, a metal powder etc. and sintering the resulting composition.

The metal terminal 5 is adapted to apply a voltage from an external voltage source to the center electrode 4 for the generation of a spark discharge between the center electrode 4 and the ground electrode 8. The metal terminal 5 is fixed in the axial hole 2 by the connection part 6, with a rear end portion of the metal terminal 5 protruding from a rear end of the insulator 3. The metal terminal 5 can be formed of a metal material such as low carbon steel.

The center electrode 4 includes a rear end portion 16 brought into contact with the connection part 6 and a rod portion 17 extending toward the front from the rear end portion 16. The center electrode 4 is fixed in the axial hole 2 by the connection part 6, with a front end portion of the center electrode 4 protruding from a front end of the insulator 3. The respective portions 16 and 17 of the center electrode 4 can be formed of a known center electrode material such as Ni alloy. Alternatively, the center electrode 4 may have an outer layer formed of Ni alloy etc. and a core coaxially embedded in the outer layer and formed of a material higher in thermal conductivity than the material of the outer layer, such as Cu, Cu alloy, Ag, Ag alloy or pure Ni.

The ground electrode 8 is, for example, substantially rectangular in cross section. The ground electrode is joined at the base end portion thereof to the front end portion of the metal shell 7 and bent at a middle portion thereof into a substantially L shape such that the distal end portion of the metal shell 7 faces the front end portion of the center electrode 4 to define the gap GA therebetween. Herein, the gap GA refers to a minimum distance between a front end face of the center electrode 4 to a side surface of the distal end portion of the ground electrode 8. In general, the gap GA is set to within the range of 0.3 to 1.5 mm. The ground electrode 8 can be formed of a known ground electrode material such as Ni alloy. Alternatively, the ground electrode 8 may have an outer layer formed of Ni alloy etc. and a core coaxially embedded in the outer layer and formed of a material higher in thermal conductivity than the material of the outer layer as in the case of the center electrode 4.

Figure 2:
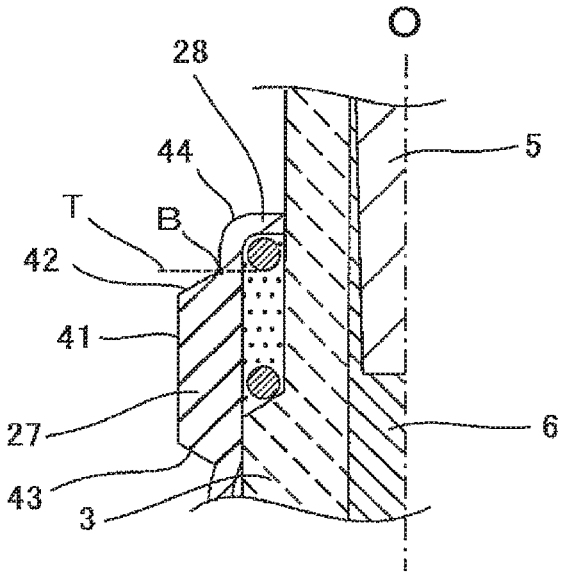
FIG. 2 is an enlarged cross-sectional view of a tool engagement portion and a crimp portion of a metal shell of the spark plug according to the one embodiment of the present invention.

The metal shell 7 has a substantially cylindrical shape and holds therein the insulator 3 by surrounding a part of the insulator 3 from the leg portion 14 to some region of the rear body portion 11 while allowing the front end portion of the insulator 3 to protrude from the front end of the metal shell 7. In the present embodiment, the metal shell 7 includes a thread portion 24, a gas seal portion 25, a compression deformation portion 26, a tool engagement portion 27 and a rear end portion (also referred to as "crimp portion") 28. The thread portion 24 is formed in an outer circumferential surface of a front part of the metal shell 7 such that the spark plug 1 is mounted to a cylinder head (not shown) of the internal combustion engine by screwing the thread portion 24 into a screw hole of the engine cylinder head. The gas seal portion 25 is located on a rear side of the thread portion 24 and formed in a collar shape. The compression deformation portion 26 is located on a rear side of the gas seal portion 25 and formed in a radially outwardly curved shape with a smaller thickness than that of the gas seal portion 25. The tool engagement portion 27 is located on a rear side of the compression deformation portion 26 and formed in a radially outwardly protruding collar shape. The tool engagement portion 27 is polygonal (e.g. hexagonal) in shape, when viewed in cross section in a direction perpendicular to the axis O, and is engageable with a plug mounting tool such as spanner or wrench. The crimp portion 28 is located on a rear side of the tool engagement portion 27 and formed with a smaller thickness than that of the tool engagement portion 27. As shown in FIG. 2, the crimp portion 28 is crimped and thereby reduced in diameter toward the rear in the direction of the axis O.

A pair of annular ring members 29 and 30 and a talc 31 are arranged in an annular space between an outer circumference of the rear body portion 11 of the insulator 3 and inner circumferences of the tool engagement portion 27 and crimp portion 28 of the metal shell 7. In the manufacturing of the spark plug 1, the rear end portion (crimp portion) 28 is deformed radially inwardly toward the front by crimping such that the rear end of the metal shell 7 is brought into contact with the outer circumference of the insulator 3. With the application of such a crimping force, the compression deformation portion 26 is compressed and deformed outwardly. As a result, the insulator 3 is pressed toward the front within the metal shell 7 via the ring members 29 and 30 and the talc 31 so as to compress the talc 31 in the direction of the axis O and enhance the air tightness of the inside of the metal shell 7.

The metal shell 7 further includes a protrusion portion 32 formed on an inner circumferential surface thereof at a position corresponding to the thread portion 24 and pressed against the step portion 15 of the insulator 3 via an annular plate packing 33. Herein, the plate packing 33 serves as an airtight seal member to maintain the air tightness between the metal shell 7 and the insulator 3 and prevent the leakage of combustion gas.

The metal shell 7 is made of a carbon steel material.

The carbon steel material of the crimp portion 28 of the metal shell 7 has a grain size number G equal to or greater than No. 11 as measured according to JIS G 0551. The greater the grain size number G of the carbon steel material, the smaller the crystal grain size of the carbon steel material, the higher the strength of the carbon steel material. It is thus preferable to increase the grain size number G of the carbon steel material for the purpose of improving the strength of the crimp portion 28. In general, the grain size number G of the carbon steel material of the crimp portion 28 is set to No. 18 or smaller. Since at least the crimp portion 28 of the metal shell 7 is formed of such a fine grain carbon steel, it is possible to impart improved strength to the crimp portion 28 whereby the metal shell 7, even when made small in diameter and thickness, is properly fixed to the insulator 3 by crimping with a sufficient force to ensure air tightness.

The grain size number G of the carbon steel material can be evaluated by the following procedure. The metal shell 7 is first cut along a plane parallel to the axis O. The cut surface of the metal shell 7 is subjected to a predetermined process as defined in JIS G 0511, thereby revealing grain boundaries at the cut surface. By microscopic observation of the cut surface, the number of crystal grains situated in an area of 1 $mm^2$ on the cut surface is measured at five or more locations each 2 mm or more apart toward the rear from the rear end of the tool engagement portion 27 in the direction of the axis O. An arithmetic mean value of the measurement results is determined as a mean grain number m. The grain size number G is then determined from the following formula: $m=8\times2^G$.

In the present embodiment, the tool engagement portion 27 includes a hexagonal cylindrical region with six circumferential sides parallel to the axis O and front and rear diameter reducing regions located on front and rear sides of the hexagonal cylindrical region. As the reference of the microscopic observation for evaluation of the grain size number G, the "rear end of the tool engagement portion 27" refers to a rear end of the rear diameter reducing region.

More specifically, in a cross section of the metal shell 7, an outer circumferential profile of the tool engagement portion 27 is defined by three line segments: a first line segment 41 representing an outer circumference of the hexagonal cylindrical section, a second line segment 42 representing an outer circumference of the rear diameter reducing region and a third line segment 43 representing an outer circumference of the front diameter reducing region as shown in FIG. 2. The second line segment 42 extends at a predetermined angle at which the tool engagement portion 27 (rear diameter reducing region) is reduced in outer diameter toward the rear. On the other hand, an outer circumferential profile of the crimp portion 28 (located on the rear side of the tool engagement portion 27) is defined by a curved line 44. As shown in FIG. 2, the curved line 44 extends toward the rear from a rear end of the second line segment 42 substantially in parallel to the axis O and then gets bent at a middle point thereof toward the radially inside such that a rear end of the curved line 44 comes into contact with the insulator 3. The "rear end of the tool engagement portion 27" refers to a change point B of diameter reduction angle between the second line segment 42 and the curved line 44. In the case where the outer circumferential surface rear diameter reducing region of the tool engagement portion 27 is curved, the term "rear end of the tool engagement portion 27" refers to a point B at which the gradient of a tangent to the curved outer circumferential surface becomes suddenly changed. The points of the microscopic observation for evaluation of the grain size number G is 2 mm or more apart toward the rear from an imaginary line T in the direction of the axis O assuming that the imaginary line T is a straight line passing through the change point B and extending perpendicular to the axis O.

Preferably, the carbon steel material of the crimp portion 28 has a mean lineal grain length of 0.01 mm or smaller where the mean lineal grain length is an arithmetic mean value of lengths of crystal grains situated on a line segment parallel to the axis O. The smaller the mean lineal grain length of the carbon steel material, the smaller the crystal grain size of the carbon steel material, the higher the strength of the carbon steel material. It is thus preferable to decrease the mean lineal grain length of the carbon steel material for the purpose of improving the strength of the crimp portion 28. In general, the mean lineal grain length of the carbon steel material of the crimp portion 28 is set to 0.005 mm or greater. By controlling the mean lineal grain length of the carbon steel material of the crimp portion 28 to 0.01 mm or smaller, it is possible to further improve the strength of the crimp portion 28 whereby the metal shell 7, even when made small in diameter and thickness, is properly fixed to the insulator 3 by crimping with sufficient force to ensure air tightness.

Figure 3:
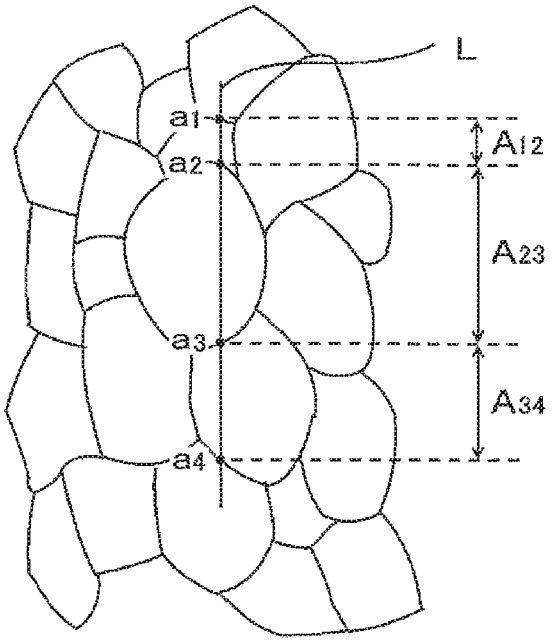
FIGS. 3 and 4 are schematic views showing methods of measuring the mean lineal grain length and intercepted grain number of a carbon steel material of the metal shell according to the one embodiment of the present invention.

The mean lineal grain length of the carbon steel material can be evaluated by the following procedure. As in the case of the evaluation of the grain size number G, a cut surface of the metal shell 7 is processed and then observed with a microscope at a location 2 mm or more apart toward the rear from the rear end of the tool engagement portion 27 in the direction of the axis O. As shown in FIG. 3, a line segment L is drawn on the microscopic image in parallel to the axis O. The lengths of the respective crystal grains on this line segment L are measured. Namely, the distances between points of intersection of the respective grain boundaries and the line segment L (in FIG. 3, the distance $A_{12}$ between point a1 and point a2, the distance $A_{23}$ between point a2 and point a3 and the distance $A_{34}$ between point a3 and point a4) are measured. An arithmetic mean value of the measured grain lengths is determined as the mean lineal grain length. The magnification of the microscope is set to a degree (e.g. 100 times) at which the number of crystal grains on the line segment L is about 200.

Further, the carbon steel material of the crimp portion 28 preferably has an intercepted grain number N greater than or equal to 200 as measured according to JIS G 0551. The greater the intercepted grain number N of the carbon steel material, the higher the strength of the carbon steel material. It is thus preferable to increase the intercepted grain number N of the carbon steel material for the purpose of improving the strength of the crimp portion 28. In general, the intercepted grain number N of the carbon steel material is set smaller than or equal to 500. It is possible by forming the crimp portion 28 from such a large grain number carbon steel material to further improve the strength of the crimp portion 28 whereby the metal shell 7, even when made small in diameter and thickness, is fixed to the insulator 3 by crimping with sufficient force to ensure air tightness.

Figure 4:
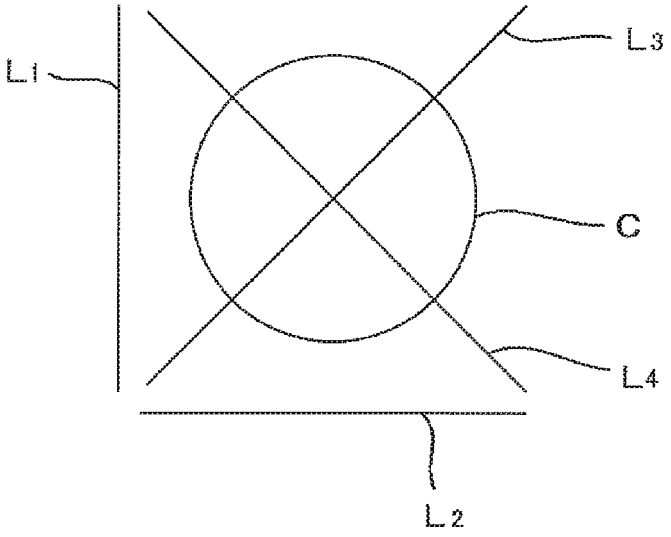

The intercepted grain number N of the carbon steel material can be evaluated by the following procedure. As in the case of the evaluation of the grain size number G, a cut surface of the metal shell 7 is processed and then observed with a microscope at a location 2 mm or more apart toward the rear from the rear end of the tool engagement portion 27 in the direction of the axis O. As shown in FIG. 4, a vertical line segment $L_1$, a horizontal line segment $L_2$, a circle C and two diagonal line segments $L_3$ and $L_4$ passing through the center of the circle C are drawn as a test line on the microscopic image. The magnification of the microscope is set to e.g. 100 times. In this case, the length of the vertical and horizontal line segments $L_1$ and $L_2$ is 276.160 μm; the lengths of the diagonal line segments $L_3$ and $L_4$ is 414.239 μm; the perimeter of the circle is 690.421 μm; and the total line length is 2071.219 μm. The number N of crystal grains intercepted with the test line is counted, as the intercepted grain number, assuming that: N=1 if the test line goes through a crystal grain; and N=0.5 if the test line terminates within a crystal grain or if the test line is tangential to a grain boundary.

In the metal shell 7, a large stress is exerted on the crimp portion 28 by crimping. As long as the carbon steel material of the crimp portion 28 has the above-specific apparent grain size, the crimp portion 28 attains sufficiently improved strength to withstand such a large stress. In terms of further strength improvement, it is preferable that the carbon steel material of not only the crimp portion 28 but also the compression deformation portion 26, or the whole of the metal shell 7, has a grain size number G equal to or greater than No. 11. It is more preferable that the carbon steel material of not only the crimp portion 28 but also the compression deformation portion 26, or the whole of the metal shell 7, has a mean lineal grain length of 0.01 mm or smaller and/or an intercepted grain number N greater than or equal to 200.

It is feasible to adjust the grain size number G, mean lineal grain length and intercepted grain number N of the carbon steel material by appropriately adjusting a cooling condition during a rolling process for the production of the metal shell 7. For example, the carbon steel material can be formed with fine crystal grains of grain size number G greater than or equal to No. 11 by rolling a carbon steel rod under heating at about 1000° C. and rapidly cooling the rolled carbon steel to 600° C. in a short time under air cooling.

The carbon steel material of the metal shell 7 contains Fe (iron) as a main component and generally further contains C (carbon), Mn (manganese), Si (silicon) and S (sulfur). Preferably, the carbon steel material has a Fe content of 97 to 99.569 mass %, a C content of 0.03 to 0.3 mass %, a Mn content of 0.3 to 0.9 mass %, a Si content of 0.1 to 0.8 mass % and a S content of 0.001 to 0.1 mass %. By controlling the composition of the carbon steel material to within this composition range, it is possible to easily form the carbon steel material with the above-specified fine crystal grains and thereby possible to sufficiently improve the strength of the crimped portion 28.

The carbon steel material of the metal shell 7 may optionally contain, as an unavoidable impurity, any element(s) other than Fe, C, Mn, Si and S. Examples of such an unavoidable impurity element(s) are P, Cu and Ni.

The contents of the respective component elements in the carbon steel material can be evaluated by point analysis with the use of a wavelength dispersive X-ray spectrometer as attached to an electron probe microanalyzer (FE-EPMA). The point analysis is performed at five or more locations each 2 mm or more apart toward the rear from the rear end of the tool engagement portion 27 in the direction of the axis O as in the case of the evaluation of the grain size number G. The content of each component element is determined by averaging the resulting analysis values.

The spark plug 1 can be manufactured by the following procedure.

The carbon steel material is first prepared as the raw material for the production of the metal shell 7. More specifically, a carbon steel rod of predetermined composition is provided and subjected to a rolling process. The rolling process is performed by e.g. heating the carbon steel rod at about 1000° C., rolling the heated carbon steel rod and rapidly cooling the rolled carbon steel to 600° C. in a short time with a relatively strong air blow. By rapidly cooling the drawn carbon steel rod in the rolling process, the carbon steel material is formed with fine crystal grains of grain size number G greater than or equal to No. 11.

Subsequently, the raw carbon steel material is pressed in a plurality of steps with a forging machine and thereby forged into a shape close to that of the metal shell 7. A semi-finished metal shell product is obtained by cutting inner and outer circumferences of the forged body with a lathe.

Separately from the metal shell 7, the center electrode 4 and the ground electrode 8 are each produced in a desired shape and dimensions from electrode material such as Ni alloy. The preparation and processing of the electrode material can be performed continuously.

Further, the insulator 3 is produced by e.g. granulating a raw material powder containing alumina as a main component, a binder etc., rubber-press molding the granulated raw material powder into a cylindrical shape, cutting the molded body into a desired shape and firing the cut molded body in a furnace.

The base end portion of the ground electrode 8 is joined by e.g. electric resistance welding to the front end face of the semi-finished metal shell product.

The center electrode 4 is fitted in the axial hole 2 of the insulator 3 by a known technique. The raw material composition for the formation of the connection part 6 is preliminarily compressed and filled in the axial hole 2 of the insulator 3. While the terminal rod 5 is press-fitted in the axial hole 2 of the insulator 3, the filled material composition is sintered by compression heating to form the connection part 6. Consequently, the center electrode 4 and the metal terminal 5 are fixed in the insulator 3 by the connection part 6.

The insulator 3 in which the center electrode 4, the metal terminal 5 etc. have been fixed is inserted into the metal shell 7 to which the ground electrode 8 has been joined, so as to bring the step portion 15 of the insulator 3 into contact with the protrusion portion 32 of the metal shell 7 via the plate packing 33. After that, the ring member 29 is disposed on the large diameter portion 12 of the insulator 3. The talc 31 is put into the annular space between the insulator 3 and the metal shell 7. The ring member 30 is disposed on the talc 31. The open rear end portion of the metal shell 7, which is made thinner than the tool engagement portion 27, is then crimped onto the insulator 3. The thus-formed crimp portion 28 is reduced in diameter toward the rear as shown in FIG. 2. As a consequence, the insulator 3 and the metal shell 7 are fixed together.

Finally, the spark plug 1 is completed by bending the ground electrode 8 toward the center electrode 4 and thereby defining the gap GA between the distal end portion of the ground electrode 8 and the front end portion of the center electrode 4.

The spark plug 1 of the present embodiment is suitably usable as an ignition plug in various types of internal combustion engines such as gasoline engine of vehicles. As mentioned above, the metal shell 7 has strength capable of, even when made small in diameter and thickness as compared to conventional metal shells, being fixed to the insulator 3 by crimping with a sufficient force to ensure air tightness. The metal shell 7 is thus particularly suitable for an internal combustion engine design with a small-size spark plug.

EXAMPLES

The present invention will be described in more detail by way of the following examples.

1. Crimp Portion Strength Test

Preparation of Metal Shell Samples

Example 1

A carbon steel rod of the following composition was subjected to a rolling process, i.e., rolling under heating at about 1000° C. and rapidly cooling to 600° C. in a short time with a relatively strong air blow. A semi-finished metal shell product 107 was obtained by forging the thus-prepared carbon steel material into a shape close to that of a metal shell through a plurality of pressing steps with a forging machine, and then, cutting inner and outer circumferences of the forged body.

(Carbon Steel Composition)

Fe: 99.307 mass %

C: 0.16 mass %

Mn: 0.38 mass %

Si: 0.14 mass %

S: 0.012 mass %

P: 0.001 mass %

Figure 5:
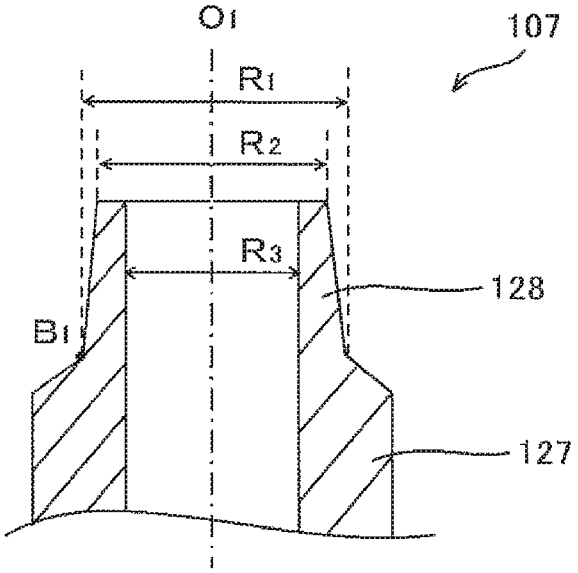
FIG. 5 is a schematic view showing the opening dimensions of a semi-finished metal shell product of the metal shell.

As shown in FIG. 5, the semi-finished metal shell product 107 had a tool engagement portion 127 and an open rear end portion (crimp portion) 128 located on a rear side of the tool engagement portion 127 in the direction of an axis $O_1$. The outer diameter $R_1$ of the semi-finished metal shell product 107 at the rear end $B_1$ of the tool engagement portion 127 was 14.8±0.1 mm; the outer diameter $R_2$ of the semi-finished metal shell product 107 at the rear end thereof was 14.5±0.1 mm; and the inner diameter $R_3$ of the semi-finished metal shell product 107 was 13.05±0.05 mm.

A metal shell sample was formed by crimping the open rear end portion 128 of the semi-finished metal shell product 127 such that the crimped rear end portion 128 was gradually reduced in diameter toward the rear.

The composition of the metal shell sample was analyzed by FE-EPMA. It was confirmed by the analysis that the composition of the metal shell sample was approximately the same as that of the carbon steel rod.

Comparative Example 1

In Comparative Example 1, a metal shell sample was formed in the same manner as in Example 1 except that a carbon steel material was prepared by, after rolling a carbon steel rod under heating at about 1000° C., gradually cooling the rolled carbon steel to 600° C. with an weaker air blow than in Example 1.

Evaluation of Grain Size Characteristics

The grain size number G, mean lineal grain length and intercepted grain number N of each metal shell sample were evaluated by analyzing a microscopic observation image of the sample with an analysis software program "Quick Grain" available from Inotech Co., Ltd. The detailed evaluation procedures are as follows.

Evaluation of Grain Size Number G

The metal shell sample (crimp portion 128) was cut along a plane parallel to the axis $O_1$. The cut surface of the metal shell sample was corroded by treatment with nital, thereby revealing grain boundaries at the cut surface. By observation of the treated cut surface with a microscope (magnification: 100 times), the number of crystal grains situated in an area of 1 $mm^2$ on the cut surface was measured at five locations 2 mm or more apart toward the rear from the rear end $B_1$ of the tool engagement portion 127 in the direction of the axis O. An arithmetic mean value of the measurement results was determined as a mean grain number m. The grain size number G was determined from the following formula: $m=8\times2^G$ according to JIS G 0551.

Evaluation of Mean Lineal Grain Length

The above-treated cut surface was observed with a microscope at arbitrary 10 locations 2 mm or more apart toward the rear from the rear end $B_1$ of the tool engagement portion 127 in the direction of the axis O. On each of the microscopic images, a line segment was drawn in parallel to the axis $O_1$ as shown in FIG. 3. The lengths of the respective crystal grains on the drawn line segment were measured. An arithmetic mean value of the measured grain lengths was determined as the mean lineal grain length. The minimum and maximum values out of these ten determination results are shown in TABLE 1. The magnification of the microscope was set to 100 times so that the line segment passed through about 200 crystal grains in each of the samples of Example 1 and Comparative Example 1.

Evaluation of Intercepted Grain Number N

The above-treated cut surface was observed with a microscope (magnification: 100 times) at a location 2 mm or more apart toward the rear from the rear end $B_1$ of the tool engagement portion 127 in the direction of the axis O. As shown in FIG. 4, a vertical line segment $L_1$, a horizontal line segment $L_2$, a circle C and two diagonal line segments $L_3$ and $L_4$ passing through the center of the circle C were drawn as a test line on the microscopic image. The length of the vertical and horizontal line segments $L_1$ and $L_2$ was 276.160 μm; the lengths of the diagonal line segments $L_3$ and $L_4$ was 414.239 μm; the perimeter of the circle was 690.421 μm; and the total line length was 2071.219 p.m. The number N of crystal grains intercepted with the test line was counted, as the intercepted grain number, according to JIS G 0551.

The evaluation results are shown in TABLE 1.

TABLE 1

| | Grain Size Number G | Mean Lineal Grain Length μm Minimum value | Maximum value | Intercepted Grain Number N |
|---|---|---|---|---|
| Example 1 | 12 | 7 | 9 | 234 |
| Comparative Example 1 | 8 | 22 | 31 | 182 |

As shown in TABLE 1, the metal shell sample of Example 1 had a greater grain size number G, i.e., smaller grain size than that of Comparative Example 1.

Strength Test Method

The metal shell sample was fixed by inserting a jig into the metal shell sample from the front end side and bringing an end of the jig into contact with an inner circumferential surface of the crimp portion. In this state, the strength test was conducted by moving the jig at a speed of 10 mm/min toward the crimp portion with the application of a load. The load applied during the strength test was measured with an autograph. The position of the rear end of the crimp portion during the strength test was also measured assuming that: the position of the rear end of the crimp portion before the application of the load was defined as 0 (zero); and the position of the rear end of the crimp portion was defined as positive when the rear end of the crimp portion was displaced toward the rear.

Figure 6:
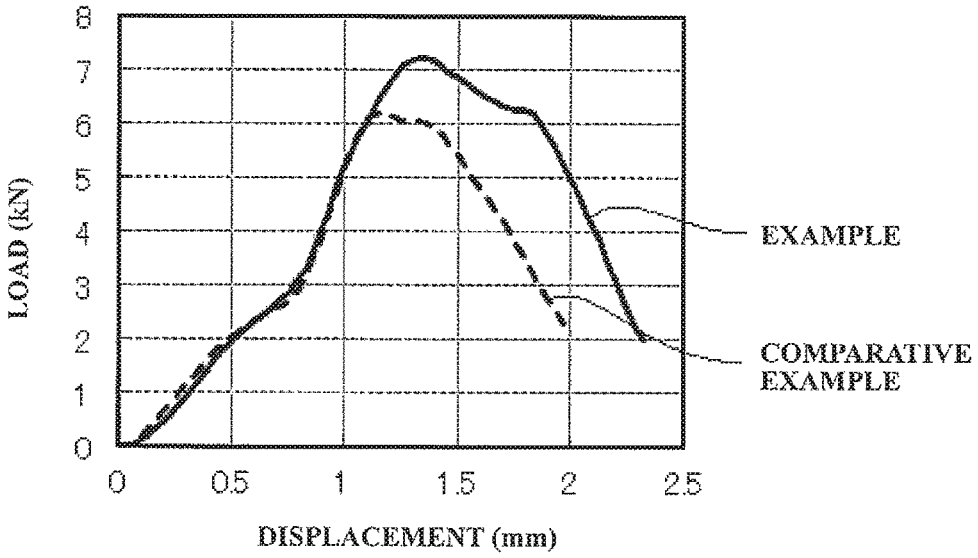
FIG. 6 is a graph showing a relationship between a load and a displacement of a rear end of the crimped portion of the metal shell.

The test results are shown in FIG. 6. In FIG. 6, the greater the maximum value of the load applied during the strength test, the higher the strength of the crimp portion. As shown in FIG. 6, the maximum value of the load applied to the metal shell sample of Example 1 was greater than that of Comparative Example 1. Thus, the crimp portion 128 of the metal shell sample of Example 1 had higher strength than that of Comparative Example 1.

2. Crimp Portion Impact Test

Preparation of Spark Plug Samples

Example 2

A spark plug sample was produced by inserting an insulator in the semi-finished metal shell product 107 obtained in Example 1, with a center electrode fitted in the insulator, and crimping the open rear end portion 128 of the semi-finished metal shell product 107 onto the insulator.

In the manufacturing of the spark plug, it is common to fix the insulator and the metal shell securely by crimping the rear end portion of the metal shell until the compression deformation portion gets radially outwardly deformed as shown in FIG. 1. In this example, however, the crimping was performed by applying a load until the rear end portion of the metal shell sample was brought into contact with the outer circumference of the insulator, rather than until the compression deformation portion was radially outwardly deformed, so that the following impact test was conducted as accelerated test.

Comparative Example 2

A spark plug sample was produced in the same manner as in Example 2 except for using the semi-finished metal shell product obtained in Comparative Example 1.

Impact Test Method

Each of the spark plug samples was mounted on an impact test machine, with the ground electrode side of the spark plug sample directed downward. In the impact test machine, an impact was applied to the spark plug sample by dropping the spark plug sample onto a test stage. This impact test was conducted continuously under the conditions that: the distance between the test stage and the front end of the spark plug sample was 15 mm; the acceleration was 20 G; and the frequency was 20 Hz.

During the impact test, the state of the spark plug sample was checked every hour and evaluated by the following criteria: "◎" when no defect was seen in the sample; "○" when the crimp portion was displaced by an amount of 0.01 mm or less in the direction of the axis $O_1$; "Δ" when the crimp portion was displaced by an amount exceeding 0.01 mm in the direction of the axis $O_1$ even though there occurred no loosening between the metal shell and the insulator; and "x" when there occurred loosening between the metal shell and the insulator.

The evaluation results are shown in TABLE 2.

TABLE 2

| | Test Time (hr) 1 | 2 | 3 | 4 | 5 | 6 | 7 | 8 |
|---|---|---|---|---|---|---|---|---|
| Example 2 | ◎ | ◎ | ◎ | ◎ | ◎ | ◎ | ◎ | ○ |
| Comparative Example 2 | ◎ | ◎ | ○ | ○ | ○ | Δ | Δ | x |

As shown in TABLE 2, there occurred loosening between the metal shell and the insulator in the spark plug sample of Example 2 after 12 hours of the impact test. The time lapsed until the occurrence of loosening between the metal shell and the insulator was longer in the spark plug sample of Example 2 than in the spark plug sample of Comparative Example 2. The spark plug sample of Example 2 was thus higher in impact resistance and durability than the spark plug sample of Comparative Example 2.

It is apparent from the test results of Examples 1-2 and Comparative Examples 1-2 that it is possible, by forming the metal shell (crimp portion) with a greater grain size number, i.e., smaller grain size, to impart higher strength to the crimp portion and provide the spark plug with improved impact resistance and durability.

The entire contents of Japanese Patent Application No. 2015-182469 (filed on Sep. 16, 2015) are herein incorporated by reference.

The present invention is not limited to the above embodiment. Various changes and modifications of the above embodiment are possible without departing from the scope of the present invention. The scope of the invention is defined with reference to the following claims.

Having described the invention, the following is claimed:

1. A spark plug comprising:

an insulator having an axial hole formed therethrough in a direction of an axis of the spark plug;

a center electrode disposed in a front side of the axial hole; and a metal shell disposed around an outer circumference of the insulator and including a collar-shaped tool engagement portion and a crimp portion located on a rear side of the tool engagement portion and reduced in diameter toward a rear in the direction of the axis, wherein the crimp portion of the metal shell is made of a carbon steel material having a grain size number in a range from No. 11 to No. 18 as measured according to JIS G 0551.

2. The spark plug according to claim 1, wherein the carbon steel material has a mean lineal grain length of 0.01 mm or smaller where the mean lineal grain length is an arithmetic mean value of lengths of crystal grains situated on a line segment parallel to the axis of the spark plug.

3. The spark plug according to claim 1, wherein the carbon steel material has an intercepted grain number greater than or equal to 200 as measured according to JIS G 0551.

4. The spark plug according to claim 1, wherein the carbon steel material contains Fe as a main component, 0.03 to 0.3 mass % of C, 0.3 to 0.9 mass % of Mn, 0.1 to 0.8 mass % of Si and 0.001 to 0.1 mass % of S.

5. The spark plug according to claim 2, wherein about 200 of the crystal grains are situated on the line segment.

6. The spark plug according to claim 1, wherein the carbon steel material has an intercepted grain number in a range of 200 to 500 as measured according to JIS G 0551.

* * * * *